US010114313B2

(12) United States Patent
Tsuji

(10) Patent No.: US 10,114,313 B2
(45) Date of Patent: Oct. 30, 2018

(54) TONER CONVEYING DEVICE, IMAGE FORMING APPARATUS

(71) Applicant: KYOCERA Document Solutions Inc., Osaka-shi, Osaka (JP)

(72) Inventor: Hirofumi Tsuji, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/495,752

(22) Filed: Apr. 24, 2017

(65) Prior Publication Data

US 2017/0315475 A1 Nov. 2, 2017

(30) Foreign Application Priority Data

Apr. 27, 2016 (JP) ..... 2016-089888

(51) Int. Cl.
*G03G 15/08* (2006.01)
*G03G 21/00* (2006.01)

(52) U.S. Cl.
CPC ..... *G03G 15/0891* (2013.01); *G03G 15/0896* (2013.01); *G03G 21/007* (2013.01)

(58) Field of Classification Search
CPC ..... G03G 15/0822; G03G 15/0887; G03G 15/0889; G03G 15/0891; G03G 15/0893; G03G 21/0005; G03G 21/007; G03G 2215/0827; G03G 2215/085; G03G 2215/0872; G03G 2221/0089
USPC ..... 399/119, 123, 254, 256, 343, 349, 358, 399/360
See application file for complete search history.

(56) References Cited

U.S. PATENT DOCUMENTS

2011/0085835 A1* 4/2011 Sato ..... G03G 21/12 399/360
2013/0216288 A1* 8/2013 Murata ..... G03G 21/105 399/358
2015/0071691 A1 3/2015 Fujii
2017/0146928 A1* 5/2017 Kusukawa ..... G03G 15/0812

FOREIGN PATENT DOCUMENTS

JP 201555675 A 3/2015

* cited by examiner

*Primary Examiner* — Benjamin R Schmitt
(74) *Attorney, Agent, or Firm* — Alleman Hall Creasman & Tuttle LLP

(57) ABSTRACT

In a toner conveying device, a conveyance path of toner is formed in the casing. A conveyance screw is supported by two support portions of the casing so as to be rotated in the conveyance path and convey the toner along the conveyance path. A low friction portion is provided on an inner side surface of the casing facing the conveyance screw, in a middle of the two support portions. The low friction portion has a lower friction coefficient with the conveyance screw than the other portions of the inner side surface. In a region along a longitudinal direction of the conveyance screw including the low friction portion, a space between the low friction portion and the conveyance screw is narrower than a space between the conveyance screw and portions of the inner side surface other than the portion on which the low friction portion is provided.

7 Claims, 3 Drawing Sheets

TONER CONVEYING DEVICE, IMAGE FORMING APPARATUS

INCORPORATION BY REFERENCE

This application is based upon and claims the benefit of priority from the corresponding Japanese Patent Application No. 2016-089888 filed on Apr. 27, 2016, the entire contents of which are incorporated herein by reference.

BACKGROUND

The present disclosure relates to a toner conveying device and an image forming apparatus including the same.

In general, an electrophotographic image forming apparatus includes a cleaning device for removing residual toner from the surface of an image carrying member. The cleaning device includes a toner conveying device for conveying the toner removed from the image carrying member.

The toner conveying device includes a casing and a conveyance screw, wherein the casing forms in its inside a conveyance path extending linearly, and the conveyance screw conveys the toner along the conveyance path. In addition, it is known that the cleaning device may include a toner crumbling member that contacts the conveyance screw.

SUMMARY

A toner conveying device according to an aspect of the present disclosure includes a casing, a conveyance screw, and a low friction portion. In the casing, a conveyance path of toner is formed. The conveyance screw is supported by two support portions of the casing so as to be rotated in the conveyance path and convey the toner along the conveyance path. The low friction portion is provided on a portion of an inner side surface of the casing facing the conveyance screw, the portion being located in a middle of the two support portions, the low friction portion having a lower friction coefficient with the conveyance screw than the other portions of the inner side surface of the casing. In a region along a longitudinal direction of the conveyance screw including the low friction portion, a space between the low friction portion and the conveyance screw is narrower than a space between the conveyance screw and portions of the inner side surface other than the portion on which the low friction portion is provided.

An image forming apparatus according to another aspect of the present disclosure includes an image carrying member and a cleaning device. The image carrying member rotates while carrying a toner image on a surface thereof. The cleaning device removes residual toner from a surface of the image carrying member after the toner image is transferred to a sheet. The cleaning device includes the toner conveying device that conveys the toner removed from the image carrying member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
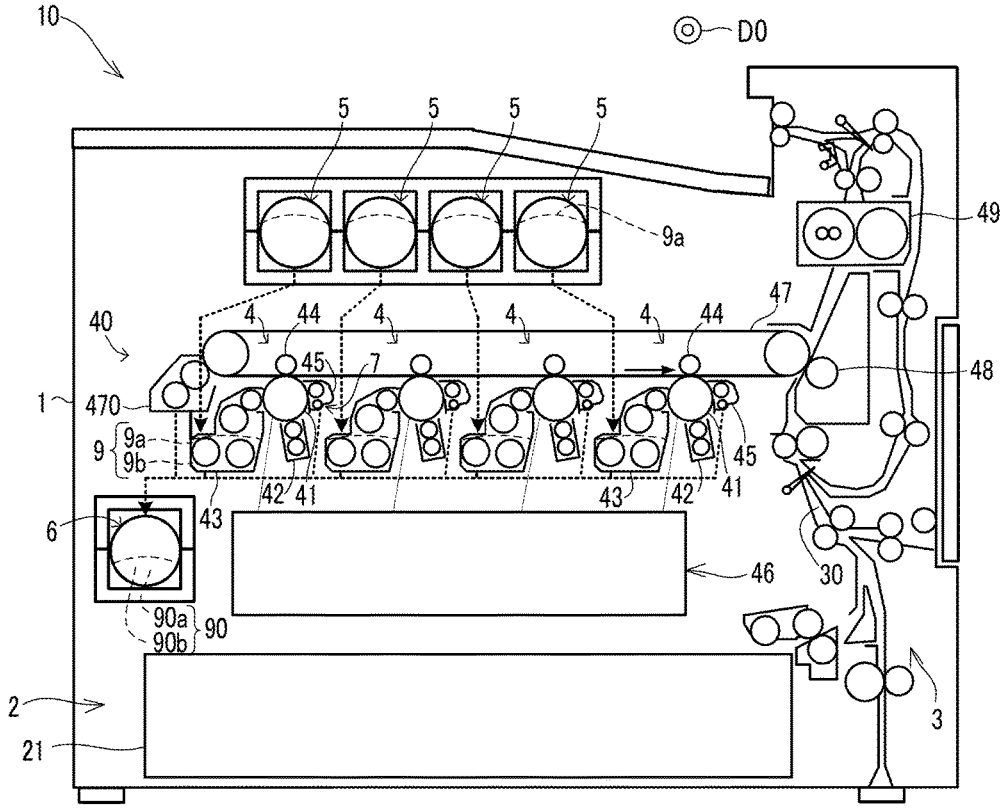
FIG. 1 is a diagram showing an image forming apparatus including a toner conveying device according to a first embodiment of the present disclosure.

The following describes embodiments of the present disclosure with reference to the accompanying drawings. It should be noted that the following embodiments are an example of specific embodiments of the present disclosure and should not limit the technical scope of the present disclosure.

[First Embodiment: Outlined Configuration of Image Forming Apparatus 10]

An image forming apparatus 10 including a toner conveying device 453 according to a first embodiment of the present disclosure, forms an image with toner 9*a* on a sheet by an electrophotography method. The sheet is a sheet-like image formation medium such as a sheet of paper or an envelope.

The image forming apparatus 10 includes, in a main body portion 1, a sheet supply portion 2, a sheet conveying portion 3, an image forming portion 40, a laser scanning unit 46, a fixing device 49, a toner replenishing unit 5, and a developer collecting unit 6.

The image forming portion 40 executes an image forming process of forming a toner image on the sheet. The image forming portion 40 executes the image forming process by using a two-component developer 9 that includes toner 9*a* and carrier 9*b*. The carrier 9*b* is a granular material having magnetism.

Each of image generating portions 4 includes a drum-like photoconductor 41, a charging device 42, a developing device 43, a primary transfer device 44, and a primary cleaning device 45. The photoconductor 41, the charging device 42, and the developing device 43 are unitized as a drum unit 70. As described below, the primary cleaning device 45 includes the toner conveying device 453.

The image forming apparatus 10 shown in FIG. 1 is a tandem-type image forming apparatus, and is a color printer. Accordingly, the image forming portion 40 includes a plurality of image generating portions 4, a plurality of toner replenishing units 5, an intermediate transfer belt 47, a secondary transfer device 48, and a secondary cleaning device 470, wherein the plurality of image generating units 4 and the plurality of toner replenishing units 5 correspond to a plurality of colors of toner 9*a*, respectively.

The sheet supply portion 2 feeds the sheet to a sheet conveyance path 30, and the sheet conveying portion 3 conveys the sheet along the sheet conveyance path 30. The toner replenishing units 5 replenish unused toner 9*a* to the developing device 43.

The drum-like photoconductor 41 rotates and the charging device 42 charges the surface of the photoconductor 41.

Furthermore, the laser scanning unit 46 writes an electrostatic latent image on the surface of the photoconductor 41 by scanning a laser beam thereon.

Furthermore, the developing device 43 develops the electrostatic latent image with the toner 9*a* included in the two-component developer 9 and thereby forms a toner image. Subsequently, the primary transfer device 44 transfers the toner image from the surface of the photoconductor 41 to the intermediate transfer belt 47. The primary cleaning device 45 removes the residual toner 9*a* from the surface of the photoconductor 41 after the image of the toner 9*a* is transferred to the sheet. The photoconductor 41 is an example of the image carrying member that rotates while carrying the image of the toner 9*a* on its surface.

The secondary transfer device 48 transfers the toner image formed on the intermediate transfer belt 47, to the sheet. The secondary cleaning device 470 removes the residual toner 9*a* from the intermediate transfer belt 47. The fixing device 49 fixes the toner image to the sheet by heating.

[Outline of Drum Unit 70]

Figure 2:
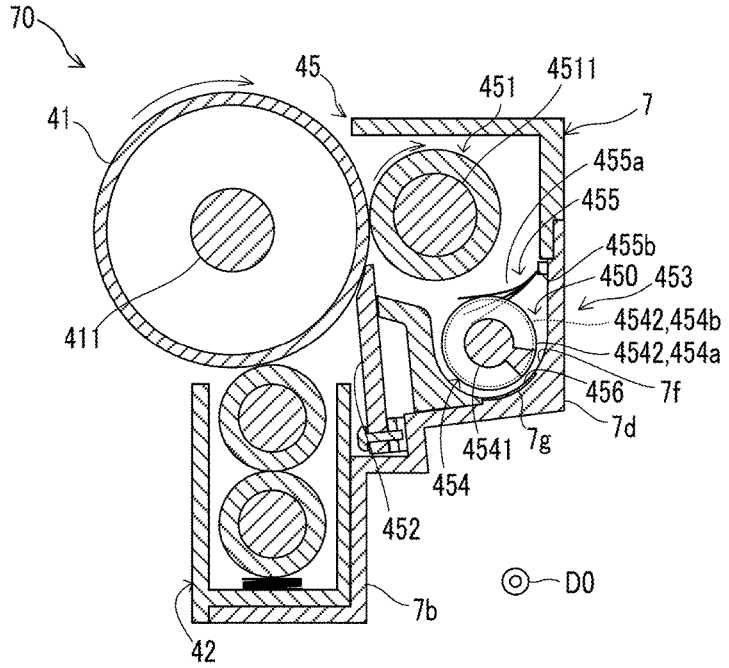
FIG. 2 is a cross-sectional view of a primary cleaning device including the toner conveying device according to the first embodiment of the present disclosure.

As shown in FIG. 2, the photoconductor 41, the charging device 42, and the primary cleaning device 45 are unitized as a drum unit 70 by a casing 7 that includes a part of the primary cleaning device 45. The casing 7 is composed of a plurality of mold members that are made of synthetic resin and integrally assembled.

The primary cleaning device 45 includes a cleaning roller 451, a cleaning blade 452, and the toner conveying device 453. The toner conveying device 453 includes a conveyance screw 454 and a toner crumbling member 455. The toner conveying device 453 is configured to convey the toner 9*a* removed from the surface of the photoconductor 41.

Figure 3:
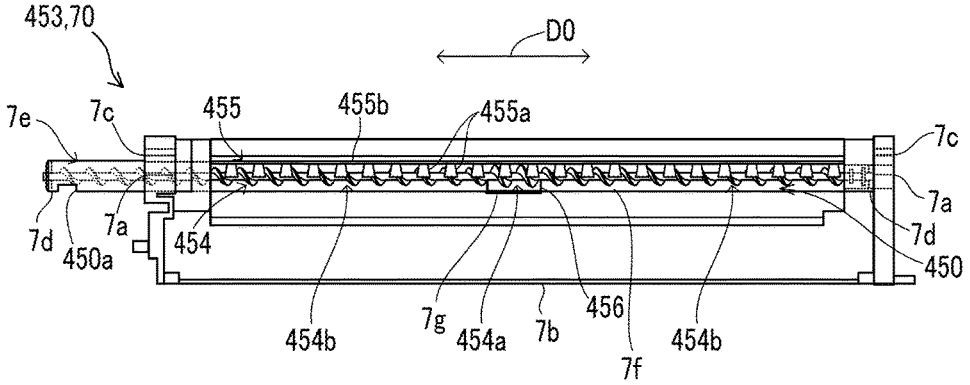
FIG. 3 is an inner front view of the toner conveying device according to the first embodiment of the present disclosure.
Figure 4:
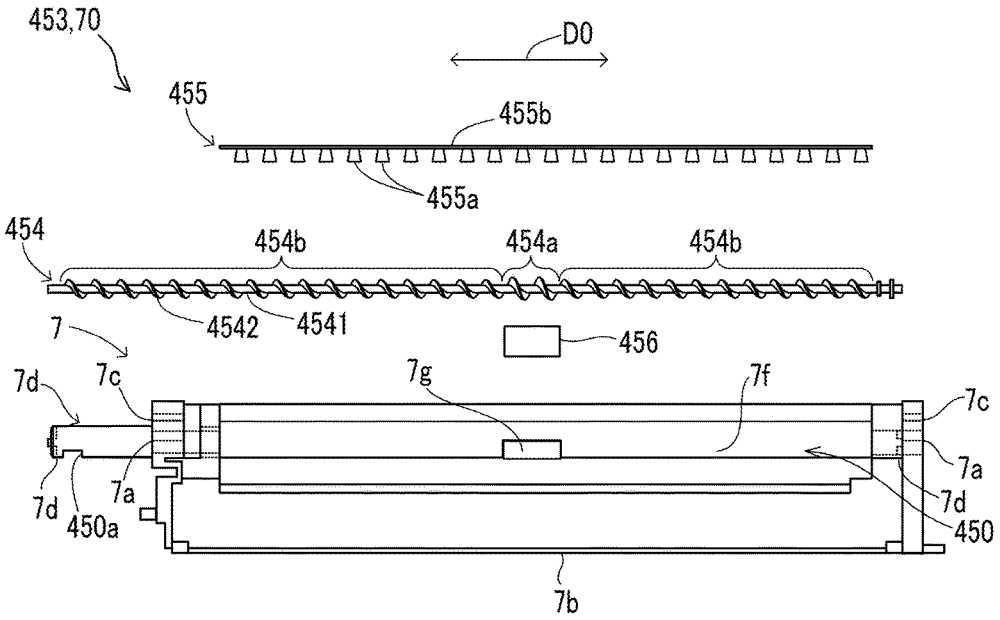
FIG. 4 is an exploded front view of the toner conveying device according to the first embodiment of the present disclosure.

As shown in FIG. 2 to FIG. 4, the conveyance screw 454 includes a shaft core portion 4541 and a spiral blade 4542, wherein the spiral blade 4542 spirally projects from the shaft core portion 4541. The toner crumbling member 455 includes a plurality of contact pieces 455*a* and a coupling portion 455*b*, wherein the contact pieces 455*a* come into contact with the conveyance screw 454, and the coupling portion 455*b* couples the plurality of contact pieces 455*a* with each other.

A rotation shaft 411 of the photoconductor 41, the cleaning blade 452, a rotation shaft 4511 of the cleaning roller 451, and the shaft core portion 4541 of the conveyance screw 454 are formed to extend along a depth direction DO of the image forming apparatus 10. The rotation shaft 411, the rotation shaft 4511, and the shaft core portion 4541 rotate upon receiving, at an end thereof, a rotational force from a motor (not shown) disposed in the main body portion 1, via a drive transmission mechanism (not shown).

The surface of the rotating cleaning roller 451 and tip end portions of the cleaning blade 452 rub the surface of the photoconductor 41, wherein the cleaning blade 452 is an elastic member made of urethan rubber or the like. This allows the residual toner 9*a* to be rubbed off the surface of the photoconductor 41.

The casing 7 includes two first bearing portions 7*a*, a charging device supporting portion 7*b*, two second bearing portions 7*c*, and two third bearing portions 7*d*, wherein the first bearing portions 7*a* rotatably support the rotation shaft 411 of the photoconductor 41, the charging device supporting portion 7*b* supports the charging device 42, the second bearing portions 7*c* rotatably support the rotation shaft 4511 of the cleaning roller 451, and the third bearing portions 7*d* rotatably support the shaft core portion 4541 of the conveyance screw 454. It is noted that the third bearing portions 7*d* are an example of the supporting portion configured to rotatably support the conveyance screw 454.

Furthermore, the casing 7 includes a conveyance path forming portion 7*e* that forms, in its inside, a toner conveyance path 450 extending linearly along the depth direction DO of the image forming apparatus 10. The conveyance screw 454 is a conveyance path in which the toner 9*a* removed from the surface of the photoconductor 41 is conveyed. It is noted that in FIG. 3 to FIG. 5, a part of the members that constitute the conveyance path forming portion 7*e* is omitted for the sake of convenience.

The conveyance screw 454 rotates in the toner conveyance path 450, and thereby conveys the toner 9*a* along the toner conveyance path 450. A discharge port 450*a* is formed in a lower portion at an end of the conveyance path forming portion 7*e* in the longitudinal direction, wherein the discharge port 450*a* is an opening through which the toner 9*a* is discharged. The toner 9*a* discharged from the discharge port 450*a* is conveyed along an intermediate conveyance path (not shown) communicated with an inlet port of the developer collecting unit 6, and then stored in the developer collecting unit 6.

The plurality of contact pieces 455*a* are film-like members that are aligned at intervals along the longitudinal direction of the conveyance screw 454. The width of each of the contact pieces 455*a* is smaller than a pitch of the spiral blade 4542 in the longitudinal direction of the conveyance screw 454. For example, the plurality of contact pieces 455*a* are formed from a PET (polyethylen terephthalate) film.

The coupling portion 455*b* of the toner crumbling member 455 is fixed to the conveyance path forming portion 7*e* of the casing 7. With this configuration, the plurality of contact pieces 455*a* are supported by the conveyance path forming portion 7*e* of the casing 7 via the coupling portion 455*b*.

In the image forming apparatus 10, for example, a low melting point toner having a melting point of lower than 150° C. is adopted as the toner 9*a*. In that case, the temperature for the heater heating control in the fixing device 49 may be set equal to or lower than 150° C. This makes it possible to suppress power consumption in the fixing device 49.

On the other hand, the toner 9*a* of the low melting point type is likely to adhere to the conveyance screw 454. If the toner 9*a* sticks to the conveyance screw 454, the conveyance efficiency is deteriorated. The toner crumbling member 455 is provided so as to prevent the toner 9*a* from sticking to the conveyance screw 454.

The plurality of contact pieces 455*a* are elastically deformed by contacting the conveyance screw 454. As the conveyance screw 454 rotates, the height of the spiral blade 4542 contacted by each of the plurality of contact pieces 455*a* changes.

As a result, each of the plurality of contact pieces 455*a* swings independently in response to the rotation of the conveyance screw 454. By swinging, the plurality of contact pieces 455*a* crumble the toner 9*a* that is present around the conveyance screw 454, thereby preventing the toner 9*a* from sticking to the conveyance screw 454.

Meanwhile, in the toner conveying device 453, to increase the toner conveyance efficiency, the dimension of an inner side surface 7*f* of the conveyance path forming portion 7*e* of the casing 7 is designed such that a space between the inner side surface 7*f* and the conveyance screw 454 is narrow.

On the other hand, since the conveyance screw 454 is thin and long, even if it is made of a material having relatively high rigidity, it is elastically deformed by the conveyance load of the toner 9*a*, or by a pressure received from the toner crumbling member 455. The conveyance screw 454 and the casing 7 may be, for example, mold members made of modified propylene.

In addition, in general, slidability and rigidity are contradictory characteristics for synthetic resin to have. That is, a synthetic resin having high rigidity, such as modified propylene, does not have excellent slidability.

As a result, in a case where the space between the inner side surface 7*f* of the conveyance path forming portion 7*e* of the casing 7 and the conveyance screw 454 is narrow, even a slight deformation of the conveyance screw 454 is likely to cause the rotating conveyance screw 454 to rub the inner side surface 7*f* of the conveyance path forming portion 7*e*, and generate an abnormal noise.

The toner conveying device 453 has a structure for preventing the rotating conveyance screw 454 from rubbing the inner side surface 7*f* of the conveyance path forming portion 7*e* of the casing 7 and generating an abnormal noise. The structure is described in the following.

[Structure of Toner Conveying Device 453]

The toner conveying device 453 includes a low friction portion 456, in addition to the conveyance screw 454, the toner crumbling member 455, and the conveyance path forming portion 7*e*.

The low friction portion 456 is provided on a portion of the inner side surface 7*f* of the conveyance path forming portion 7*e* facing the conveyance screw 454, the portion being located in a middle of the two third bearing portions 7*d*. In the example shown in FIG. 3, the low friction portion 456 is provided at a center of a range in which the plurality of contact pieces 455*a* are aligned in the longitudinal direction of the conveyance screw 454.

The low friction portion 456 has a lower friction coefficient with the conveyance screw 454 than the other portions of the inner side surface 7*f* of the conveyance path forming portion 7*e*. The low friction portion 456 may be, for example, a sheet-like member made of UHMWPE (ultra-high molecular weight polyethylene) or PET.

As shown in FIG. 2, the inner side surface 7*f* of the conveyance path forming portion 7*e* is formed to be curved along the circumference of the conveyance screw 454. The sheet-like low friction portion 456 is stuck on the curved inner side surface 7*f* of the conveyance path forming portion 7*e*. The sheet-like, flexible low friction portion 456 is suited for being stuck on the curved inner side surface 7*f*.

In the example shown in FIG. 2 and FIG. 3, a portion of the inner side surface 7*f* of the conveyance path forming portion 7*e* on which the low friction portion 456 is provided is a recessed portion 7*g* whose depth is equal to or smaller than the thickness of the low friction portion 456. With this configuration, the recessed portion 7*g* serves as a marker indicating a sticking position of the low friction portion 456.

Furthermore, the surface of the low friction portion 456 is made flush or substantially flush with the portions of the inner side surface 7*f* of the conveyance path forming portion 7*e* surrounding the low friction portion 456. This prevents the low friction portion 456 from becoming resistant to conveyance of the toner 9*a*.

In addition, in a region along the longitudinal direction of the conveyance screw 454 including the low friction portion 456, a space between the low friction portion 456 and the conveyance screw 454 is narrower than a space between the conveyance screw 454 and portions of the inner side surface 7*f* other than the portion on which the low friction portion 456 is provided. With this configuration, deformation of the conveyance screw 454 in a direction intersecting the longitudinal direction of the conveyance screw 454, is suppressed by the low friction portion 456.

Accordingly, the elastically deformed conveyance screw 454 is prevented from contacting the portions of the inner side surface 7*f* other than the portion on which the low friction portion 456 is provided. In addition, even if the conveyance screw 454 rotates while rubbing the low friction portion 456 having a low friction resistance, a harsh abnormal noise is not generated.

In the present embodiment, the conveyance screw 454 includes a large diameter portion 454*a* and small diameter portions 454*b*, wherein the large diameter portion 454*a* is disposed to face the low friction portion 456. The large diameter portion 454*a* is larger in outer diameter than the other portions of the conveyance screw 454, namely, the small diameter portions 454*b*.

For example, the shaft core portion 4541 may be uniform in diameter in the longitudinal direction, and the spiral blade 4542 of the large diameter portion 454*a* may be higher in height than the spiral blade 4542 of the small diameter portions 454*b*.

According to the present embodiment, a projection that may be resistant to conveyance of the toner 9*a* is not formed on the inner side surface 7*f* of the conveyance path forming portion 7*e*, and it is possible to form a region in which a space between a part of the inner side surface 7*f* of the conveyance path forming portion 7*e* and the conveyance screw 454 is narrow.

As described above, with the adoption of the toner conveying device 453, it is possible to prevent a situation where the rotating conveyance screw 454 rubs the inner side surface of the casing 7 and an abnormal noise is generated.

In addition, since the conveyance screw 454 is pushed by the elastic force of the plurality of contact pieces 455*a*, the middle portion of the conveyance screw 454 is deformed and displaced toward a side of the conveyance screw 454 opposite to a side that contacts the plurality of contact pieces 455*a*. In view of this, as shown in FIG. 2, the low friction portion 456 is provided to face the side of the conveyance screw 454 opposite to the side that contacts the plurality of contact pieces 455*a*. With this configuration, even when the low friction portion 456 is small, it is possible to prevent an abnormal noise from being generated in a reliable manner.

[Second Embodiment]

Figure 5:
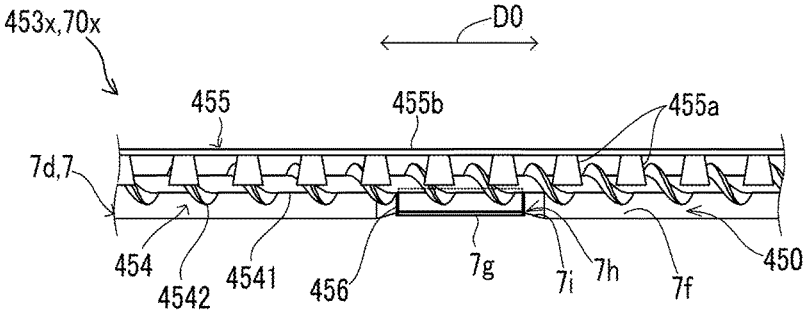
FIG. 5 is a front view of a main part of a toner conveying device according to a second embodiment of the present disclosure.

Next, a toner conveying device 453*x* according to a second embodiment is described with reference to FIG. 5. In the following, differences of the toner conveying device 453*x* from the toner conveying device 453 are described. In FIG. 5, the same components as those shown in FIG. 1 to FIG. 4 are assigned the same reference signs.

In the toner conveying device 453*x*, too, the space between the low friction portion 456 and the conveyance screw 454 is narrower than the space between the conveyance screw 454 and the portions of the inner side surface 7*f* other than the portion on which the low friction portion 456 is provided.

In the toner conveying device 453*x*, the portion of the conveyance screw 454 that faces the low friction portion 456 and the other portions thereof have the same outer diameter. However, the portion of the inner side surface 7*f* of the conveyance path forming portion 7*e* on which the low friction portion 456 is provided is a protruding portion 7*h* that protrudes toward the conveyance screw 454.

According to the present embodiment, too, the elastically deformed conveyance screw 454 is prevented from contacting the portions of the inner side surface 7*f* other than the protruding portion 7*h* on which the low friction portion 456 is provided.

With the adoption of the toner conveying device 453*x*, as with the adoption of the toner conveying device 453, it is possible to prevent a situation where the rotating conveyance screw 454 rubs the inner side surface of the casing 7 and an abnormal noise is generated.

In addition, the recessed portion 7*g* whose depth is equal to or smaller than the thickness of the low friction portion 456 is formed in the protruding portion 7*h* of the inner side surface 7*f* of the conveyance path forming portion 7*e*. Furthermore, in the inner side surface 7*f* of the conveyance path forming portion 7*e*, at least a side of the protruding portion 7*h* located on the upstream side in the toner 9*a* conveyance direction is an inclined surface 7*i*. This prevents the protruding portion 7*h* and the low friction portion 456 from becoming resistant to the conveyance of the toner 9*a*.

[Application Examples]

In the toner conveying device 453, 453*x*, the low friction portion 456 may be provided at a center between the two third bearing portions 7*d* supporting the conveyance screw 454.

In addition, in the toner conveying device 453 shown in FIG. 2 to FIG. 4, the portion of the conveyance screw 454 that faces the low friction portion 456 and the other portions may have the same outer diameter. In this case, the low friction portion 456 may be provided at a center between the two third bearing portions 7*d* supporting the conveyance screw 454.

In general, deformation of the conveyance screw 454 in a direction intersecting the longitudinal direction of the conveyance screw 454 is at maximum at the center between the two third bearing portions 7*d*. As a result, when the low friction portion 456 is provided at the center between the two third bearing portions 7*d*, even without the large diameter portion 454*a*, the deformed conveyance screw 454 is prevented from contacting the portions of the inner side surface 7*f* other than the portion on which the low friction portion 456 is provided.

In addition, the toner conveying device 453, 453*x* may be applied to other portions of the image forming apparatus 10, such as a device for conveying the toner 9*a* discharged from the primary cleaning device 45, to the developer collecting unit 6.

In addition, in the toner conveying device 453, 453*x*, the low friction portion 456 may be disposed at a plurality of locations in the longitudinal direction of the conveyance screw 454.

It is noted that the toner conveying device and the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A toner conveying device comprising:

a casing in which a conveyance path of toner is formed;

a conveyance screw supported by two support portions of the casing so as to be rotated in the conveyance path and convey the toner along the conveyance path; and a low friction portion provided on a portion of an inner side surface of the casing facing the conveyance screw, the portion being located in a middle of the two support portions, the low friction portion having a lower friction coefficient with the conveyance screw than other portions of the inner side surface of the casing, wherein in a region along a longitudinal direction of the conveyance screw including the low friction portion, a space between the low friction portion and the conveyance screw is narrower than a space between the conveyance screw and portions of the inner side surface other than the portion on which the low friction portion is provided, and the portion of the inner side surface of the casing on which the low friction portion is provided is a recessed portion whose depth is equal to or smaller than a thickness of the low friction portion.

2. The toner conveying device according to claim 1, wherein a portion of the conveyance screw facing the low friction portion is larger in outer diameter than other portions of the conveyance screw.

3. The toner conveying device according to claim 1, wherein the low friction portion is provided at a center between the two support portions.

4. The toner conveying device according to claim 1, wherein the inner side surface of the casing is formed to be curved along a circumference of the conveyance screw, and the low friction portion is a sheet-like member stuck on the curved inner side surface of the casing.

5. An image forming apparatus comprising:

an image carrying member configured to rotate while carrying a toner image on a surface thereof; and a cleaning device configured to remove residual toner from the surface of the image carrying member after the toner image is transferred to a sheet, wherein the cleaning device includes the toner conveying device according to claim 1 configured to convey the toner removed from the image carrying member.

6. A toner conveying device comprising:

a casing in which a conveyance path of toner is formed;

a conveyance screw supported by two support portions of the casing so as to be rotated in the conveyance path and convey the toner along the conveyance path;

a low friction portion provided on a portion of an inner side surface of the casing facing the conveyance screw, the portion being located in a middle of the two support portions, the low friction portion having a lower friction coefficient with the conveyance screw than other portions of the inner side surface of the casing; and a toner crumbling member supported by the casing and including a plurality of contact pieces that are aligned at intervals along a longitudinal direction of the conveyance screw and elastically deformed by contacting the conveyance screw, wherein in a region along the longitudinal direction of the conveyance screw including the low friction portion, a space between the low friction portion and the conveyance screw is narrower than a space between the conveyance screw and portions of the inner side surface other than the portion on which the low friction portion is provided, and the low friction portion is provided to face a side of the conveyance screw opposite to a side thereof that contacts the plurality of contact pieces.

7. An image forming apparatus comprising:

an image carrying member configured to rotate while carrying a toner image on a surface thereof; and a cleaning device configured to remove residual toner from the surface of the image carrying member after the toner image is transferred to a sheet, wherein the cleaning device includes the toner conveying device according to claim 6 configured to convey the toner removed from the image carrying member.

* * * * *